US008121507B2

(12) United States Patent
Tabata

(10) Patent No.: US 8,121,507 B2
(45) Date of Patent: Feb. 21, 2012

(54) IMAGE FORMING APPARATUS PREVENTING SHEET TRANSFER DEVIATION OR SLIPPAGE THROUGH FINE DETECTION OF LOOP AMOUNT

(75) Inventor: Fujio Tabata, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 837 days.

(21) Appl. No.: 12/221,075

(22) Filed: Jul. 31, 2008

(65) Prior Publication Data

US 2009/0052926 A1 Feb. 26, 2009

(30) Foreign Application Priority Data

Jul. 31, 2007 (JP) ..... 2007-198867

(51) Int. Cl.
*G03G 15/16* (2006.01)
*G03G 15/20* (2006.01)

(52) U.S. Cl. ..... 399/68; 399/397; 399/400

(58) Field of Classification Search ..... 399/68, 399/397, 400, 388
See application file for complete search history.

(56) References Cited

U.S. PATENT DOCUMENTS

| | | | | |
|---|---|---|---|---|
| 6,564,025 | B2 * | 5/2003 | Sameshima et al. | 399/68 |
| 7,634,208 | B2 * | 12/2009 | Sugiyama | 399/68 |
| 2006/0222394 | A1 * | 10/2006 | Koshida | 399/68 |

FOREIGN PATENT DOCUMENTS

| | | | |
|---|---|---|---|
| JP | 07-234604 | | 9/1995 |
| JP | 2005-173121 | | 6/2005 |
| JP | 2006-010722 | A * | 1/2006 |
| JP | 2007-308206 | A * | 11/2007 |

* cited by examiner

*Primary Examiner* — Sophia S Chen
(74) *Attorney, Agent, or Firm* — Jordan and Hamburg LLP

(57) ABSTRACT

An image forming apparatus capable of forming an image without transfer deviation or rumples by detecting the loop amount of the sheet material with a plurality of thresholds at multiple stages through a loop amount detecting portion detecting the loop amount of a sheet passing between conveyance guide members. The loop amount finely detected at the multiple stages through the loop amount detecting portion is reflected in a control and drive system, and, as a result, the sheet material can be conveyed while keeping the loop of the sheet material passing between the conveyance guide members at an appropriate amount.

5 Claims, 4 Drawing Sheets

Fig.4

| | Area A | Area B | Area C | Area D |
|---|---|---|---|---|
| First rotational position sensor | OFF | OFF | ON | ON |
| Second rotational position sensor | OFF | ON | ON | OFF |
| Loop amount | Small | Moderately small | Moderately large | Large |

IMAGE FORMING APPARATUS PREVENTING SHEET TRANSFER DEVIATION OR SLIPPAGE THROUGH FINE DETECTION OF LOOP AMOUNT

This application claims priority to Japanese Patent Application No. 2007-198867 filed Jul. 31, 2007. The contents of Japanese Patent Application No. 2007-198867 are hereby incorporated by reference into the present application in their entirety.

BACKGROUND OF THE INVENTION

1. Technical Field

The present invention relates to an image forming apparatus that forms an image on a sheet material according to an electrophotographic method, and, more particularly, to an image forming apparatus capable of conveying a sheet material while keeping the loop of the sheet material between a transferring portion and a fixing portion at an appropriate amount.

2. Background Art

In an image forming apparatus using an electrophotographic method, a toner image on a photoconductor is first transferred to a sheet material by means of a transferring portion. Thereafter, the sheet material is allowed to pass through a conveying guide, and is guided to a nip of a fixing device. Herein, there is a case in which the trailing edge of the sheet material has not yet passed through the transferring portion when the leading edge of the sheet material enters the nip of the fixing device.

On the other hand, there is a case in which a difference arises between the sheet material conveying speed in the fixing device and the sheet material conveying speed in the transferring portion because of thermal expansion of a pressure roller provided in the fixing device, an individual difference, or a time-dependent change. In this case, if the sheet material conveying speed in the fixing device exceeds the sheet material conveying speed in the transferring portion, the sheet material carrying a not-yet-fixed toner image will be pulled toward the fixing device between the fixing device and the transferring portion, and, as a result, there is a fear that transfer deviation or slippage will occur.

To prevent the occurrence of this transfer deviation phenomenon, it has been conventionally performed to form a loop (i.e., a slackened state) for a sheet material conveyed between the transferring portion and the fixing device. However, there is a fear that the sheet material will be rumpled the next time if an excessive loop is given to the sheet material. Therefore, it is desired that the sheet material be conveyed while keeping its loop amount between the transferring portion and the fixing device at an appropriate amount.

A technique is known as an approach to respond to this request. This technique is carried out in the following way. In an image forming apparatus including a fixing unit and a transferring unit, drive systems are provided independently of each other for the fixing and transferring units, respectively. The upper limit and the lower limit of a loop amount formed by a sheet of paper at the front of an entrance of the fixing unit are detected. When its upper limit is detected, the speed of a driving portion provided on the side of the fixing unit is increased. When its lower limit is detected, the speed of the driving portion provided on the side of the fixing unit is decreased. Based on the loop amount detected in this way, the conveying speed of the sheet material is controlled. (See Japanese Published Unexamined Patent Application No. H7-234604).

However, in the conventional technique, the conveying speed of the sheet material is controlled based on the upper limit and the lower limit of the loop amount detected as above, and hence excellent results have not yet been achieved from the viewpoint of forming an image without transfer deviation or without rumples. In other words, to form an image without transfer deviation or rumples, there is a need to finely detect a loop amount and to reflect this in a control system for controlling the conveying speed. However, in the conventional technique, it is impossible to finely detect the loop amount at multiple stages including intermediate stages between the upper limit and the lower limit. Therefore, satisfactory results have not yet been achieved from the viewpoint of forming an image without transfer deviation or rumples.

SUMMARY OF THE INVENTION

It is an object of the present invention to obtain an image forming apparatus capable of forming an image without transfer deviation or rumples.

To achieve the object, the image forming apparatus of the present invention is most prominently characterized by including an image carrier by which a toner image is carried, a transferring portion configured to transfer the toner image of the image carrier to a sheet material, a fixing portion configured to fix a transferred toner image of the sheet material, a fixing and driving portion configured to send the sheet material onto which the toner image has been fixed in the fixing portion, a conveyance guide member configured to guide the sheet material sent from the transferring portion toward the fixing portion, a loop amount detecting portion configured to detect a loop amount of the sheet material passing by the conveyance guide member with a plurality of thresholds at multiple stages, and a drive controller carrying out drive control of the fixing and driving portion based on a detection result of the loop amount detecting portion.

In the image forming apparatus of the present invention, the loop amount detecting portion to detect the loop amount of a sheet passing by the conveyance guide member detects the loop amount of the sheet with a plurality of thresholds at multiple stages, such as at least three stages. Consequently, in the drive controller, the loop amount finely detected at the multiple stages is fed back as a controllability driving factor of the fixing and driving portion, and, as a result, the sheet material can be conveyed while keeping the loop of the sheet material passing by the conveyance guide member at an appropriate amount, and hence a contribution can be made to the formation of an image without transfer deviation or rumples.

BRIEF DESCRIPTION OF THE DRAWINGS

FIG. 4 is an explanatory view for explaining one example of a loop amount conversion table according to the embodiment of the present invention.

DETAILED DESCRIPTION OF THE INVENTION

An image forming apparatus according to an embodiment of the present invention will be hereinafter described in detail with reference to the attached drawings.

Figure 1:
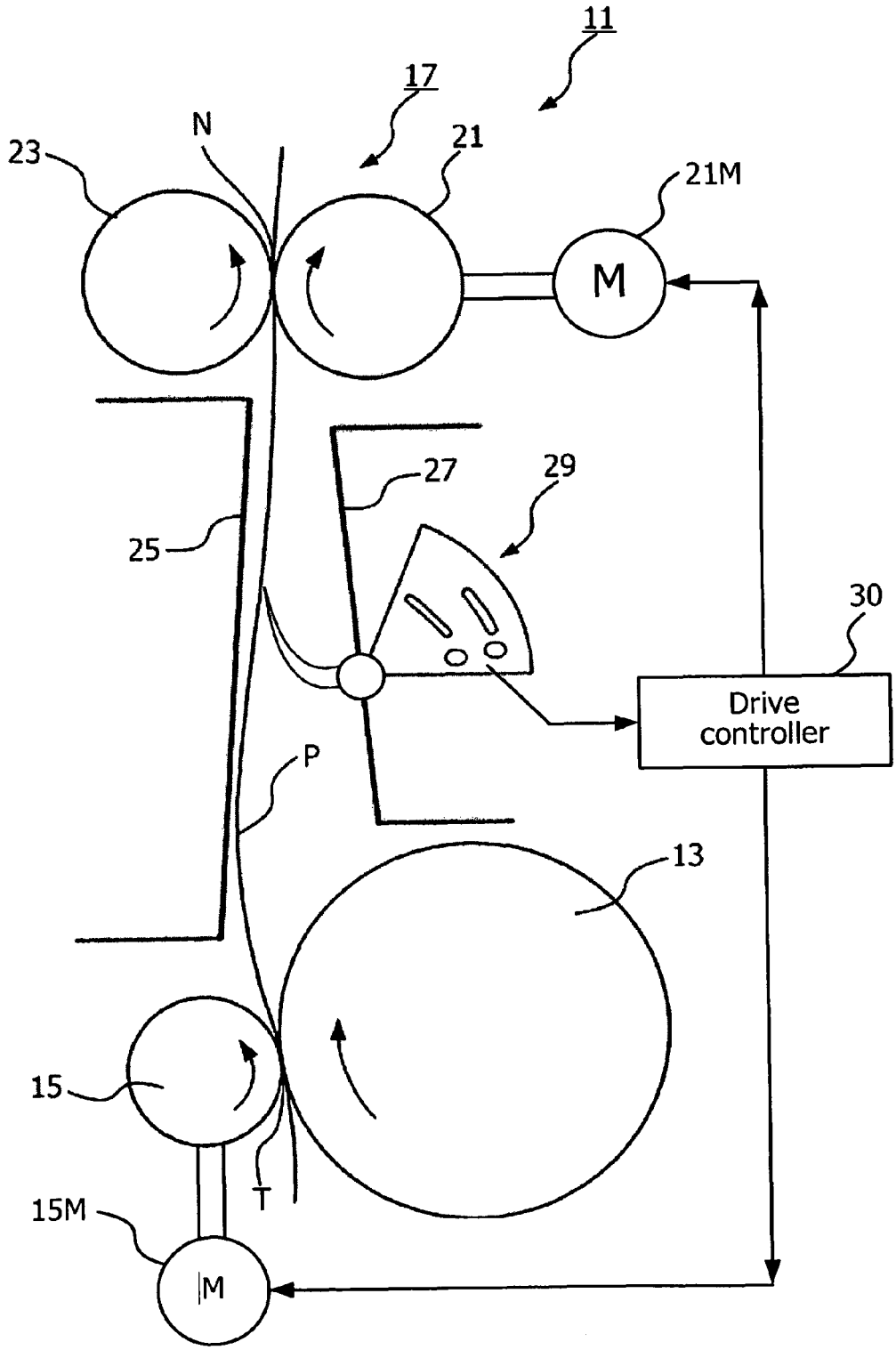
FIG. 1 is a schematic view illustrating a main part of an image forming apparatus according to an embodiment of the present invention.

As shown in FIG. 1, an image forming portion 11 of the image forming apparatus according to the embodiment of the present invention serves to convey a sheet material P upwardly from below in the vertical direction. An electrophotoconductor 13 serving as an image carrier is disposed on the upstream side in a sheet material conveying direction. The photoconductor 13 has an organic photosensitive layer formed on an outer circumferential surface of an electrically-conductive photoconductor base, and is rotationally driven at a predetermined peripheral speed (process speed) in the clockwise direction as shown by the arrow in FIG. 1. The circumferential surface of the photoconductor 13 is charged by a charging device (not shown) during its rotation so as to have a predetermined polarity and a predetermined electric potential. In this embodiment, its circumferential surface is primarily charged so as to have a predetermined electric potential of a negative polarity. The charged surface of the photoconductor is subjected to laser scanning exposure of image information by use of a laser scanner (not shown). As a result, the electric potential of an exposure bright section of the charged surface of the photoconductor is attenuated, and an electrostatic latent image corresponding to a scanning exposure pattern is formed. Thereafter, this electrostatic latent image is developed as a developer image (hereinafter, referred to as "toner image") by use of a developing device (not shown). In this embodiment, the electrostatic latent image is subjected to reversal development (i.e., adhesion of a toner to the exposure bright section) by means of a negative toner charged to have a negative polarity.

In a transfer nip portion T with which the photoconductor 13 and a transfer roller (transferring portion) 15 are brought into contact, the toner image is sequentially transferred onto a sheet material P fed from a paper feed mechanism (not shown) In a process in which the sheet material P is conveyed by running a transfer roller drive motor (transfer driving portion) 15M connected to the transfer roller 15 in a state in which the sheet material P is nipped in the transfer nip portion T, a predetermined transfer bias is applied to the transfer roller 15, and the toner image on the surface of the photoconductor 13 is electrostatically transferred to the surface of the sheet material P in sequence.

The sheet sent from the transfer nip portion T is separated from the surface of the photoconductor 13, and is conveyed to a fixing device (fixing portion) 17. The surface of the photoconductor 13 from which the sheet has been separated is cleaned by a cleaner (not shown) so as to remove any adhered matter, such as a transfer residual toner, and is used to repeatedly form an image.

The fixing device 17 is a heating device of, for example, a pressure rotational body driving type, and is made up of a fixing roller 21 and a pressure roller 23 connected to the fixing roller 21 via a gear mechanism (not shown). A fixing nip portion N is formed between the fixing roller 21 and the pressure roller 23. In the fixing nip portion N, a not-yet-fixed toner image conveyed from the transfer nip portion T is melted and fixed by being heated and pressed. The fixing roller 21 and the pressure roller 23 are members whose longitudinal direction is a direction perpendicular to the plane of the drawing paper in FIG. 1. While the sheet material P is passing through the fixing nip portion N and is being nipped in the fixing nip portion N, a fixing roller drive motor (fixing and driving portion) 21M connected to the fixing roller 21 is driven, so that the fixing roller 21 and the pressure roller 23 are synchronously rotated by means of the gear mechanism (refer to the arrow direction in FIG. 1), and, as a result, the sheet material P is discharged and conveyed toward mechanisms disposed on the downstream side. Instead of the thus formed structure, the following structure may be adopted. In detail, a pressure roller drive motor (not shown) is also connected to the pressure roller 23 without connecting the fixing roller 21 and the pressure roller 23 together via the gear mechanism, so that a fixing and driving portion is composed of the fixing roller drive motor 21M and the pressure roller drive motor. Through the cooperative operation of the fixing and driving portions, the sheet material P is discharged and conveyed toward mechanisms disposed on the downstream side while being nipped in the fixing nip portion N.

A pair of conveyance guide members 25 and 27 that guide the conveyance of sheet materials are disposed in a path leading from the transfer roller 15 to the fixing device 17 so as to face each other across a sheet material P therebetween. The conveyance guide member 27, which is one of the paired members, is provided with a loop amount sensor 29 detecting the loop amount of a sheet material. The loop amount sensor 29 is disposed approximately at the midpoint of a sheet material conveying path leading from the transfer nip portion T to the fixing nip portion N. The reason why the loop amount sensor 29 is disposed at that point is that, presumably, the loop amount of the sheet material leading from the transfer nip portion T to the fixing nip portion N is maximized near the midpoint. Preferably, the loop amount sensor 29 is disposed at a certain degree of distance from the fixing device 17. The reason is that this arrangement makes it possible to previously avoid the influence of heat generated in the fixing device 17 on the loop amount sensor 29. The loop amount sensor 29 serves to detect the loop amount of a sheet material at multiple stages. A drive controller 30 is connected to the drive systems, such as the transfer roller drive motor (transfer driving portion) 15M and the fixing roller drive motor (fixing and driving portion) 21M, in order to controllably rotate and drive these drive systems individually and independently. Based on the loop amount of the sheet material P detected by the loop amount sensor 29 at the multiple stages, the drive controller 30 controllably drives only the fixing and driving portion or controllably drives the transfer driving portion and the fixing and driving portion cooperatively with each other and independently of each other. As a result, the drive controller 30 can serve to convey sheet materials while keeping the loop of a sheet material P while passing between the conveyance guide members 25 and 27 at an appropriate amount. In other words, the drive controller 30 controllably drives the fixing and driving portion so as to decrease the conveying speed of the fixing and driving portion, for example, when the loop amount sensor 29 detects that the loop amount of the sheet material P is too small, whereas the drive controller 30 controllably drives the fixing and driving portion so as to increase the conveying speed of the fixing and driving portion when the loop amount sensor 29 detects that the loop amount of the sheet material P is excessive, thus adjusting the loop amount of the sheet material P to be kept at an appropriate amount. Instead of the thus formed structure, the following structure may be adopted. In detail, the drive controller 30 controllably drives the transfer driving portion and the fixing and driving portion cooperatively with each other and independently of each other so that the conveying speed of the fixing and driving portion becomes slower than that of the transfer driving portion, for example, when the loop amount sensor 29 detects that the loop amount of the sheet material P is too small, whereas the drive controller 30 controllably drives the transfer driving portion and the fixing and driving portion cooperatively with each other and independently of each other so that the conveying speed of the fixing and driving portion becomes faster than that of the transfer driving portion when the loop amount sensor 29 detects that the loop amount of the sheet material P is excessive, thus adjusting the loop amount of the sheet material P to be kept at an appropriate amount.

Figure 2:
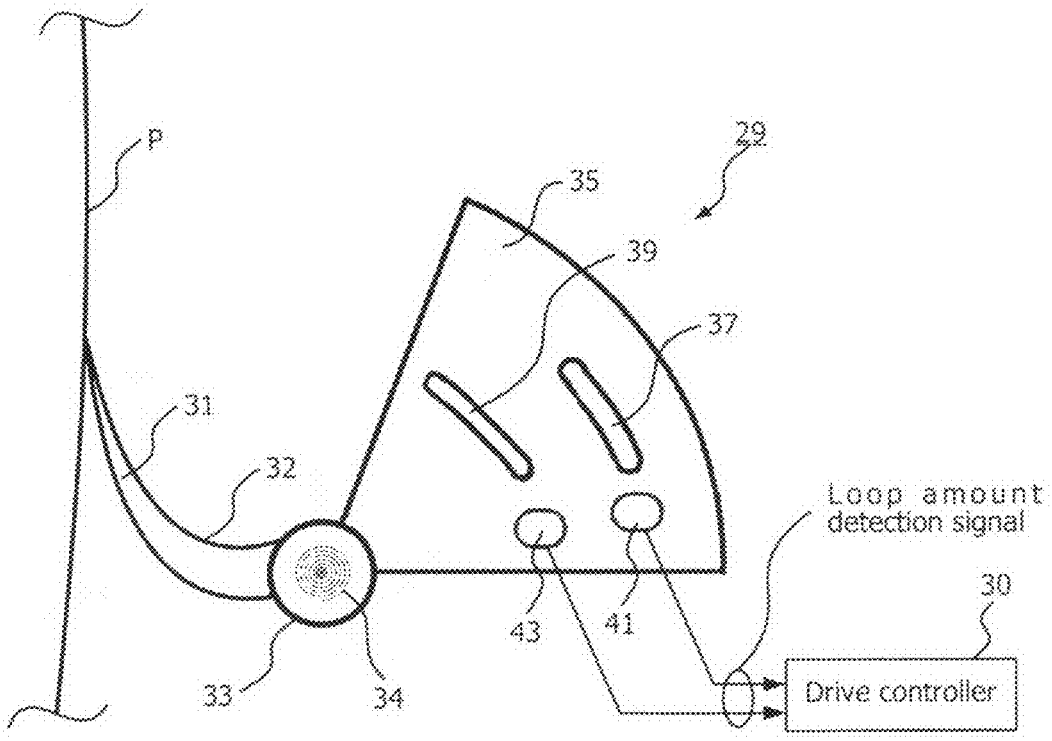
FIG. 2 is an enlarged external view of a loop amount sensor according to the embodiment of the present invention.

As shown in FIG. 2, the loop amount sensor 29 is disposed at the convex side of the loop in a sheet material P passing between the pair of conveyance guide members 25 and 27, and is made up of a contact portion 31 coming into contact with a sheet material P passing between the conveyance guide members 25 and 27 and that changes its position in accordance with the loop amount of the sheet material P, a support shaft 33 configured to support rotatably the contact portion 31, a spiral spring (urging member) 34 provided inside the support shaft 33 and configured to urge the contact portion 31 toward the back of the sheet material P, and a substantially fan-shaped detecting member 35 that pivots together with the contact portion 31 while being pivotally supported by the support shaft 33 and that detects the loop amount of the sheet material P. The contact portion 31 is bent at its intermediate part 32 so that its tip end forms an acute angle with the direction of movement of the sheet material P. This makes it possible to prevent the sheet material P from being damaged due to contact of the contact portion 31 with the sheet material P and to detect the loop amount of the paper P without missing a slight change in the amount thereof. In the spiral spring 34, one end of a spring member is fixed to the stationary side, and the other end thereof is firmly fixed to the side of the support shaft 33. Thus, the contact portion 31 is urged toward the sheet material P.

The detecting member 35 has a pair of to-be-detected parts 37 and 39 that are coaxial with the support shaft 33 and that draw continuous trajectories in the circumferential direction. Each of the to-be-detected parts 37 and 39 is provided at a predetermined distance from the support shaft 33. The pair of to-be-detected parts 37 and 39 have predetermined widths and predetermined lengths, respectively, and are disposed to differ from each other in phase in the circumferential direction.

A pair of first and second rotational position sensors 41 and 43 each of which detects the rotational position of the detecting member 35 are disposed at positions on the fixing side that correspond to the trajectories of the pair of to-be-detected parts 37 and 39, respectively. Each of the first and second rotational position sensors 41 and 43 can be formed of, for example, a photointerrupter. The first and second rotational position sensors 41 and 43 emit light onto the pair of to-be-detected parts 37 and 39, respectively, on the other hand, detect the presence or absence of the reflection of the light emitted therefrom. Based on gray code information concerning the presence or absence of reflected light detected thereby and based on a previously-stored loop amount conversion table (described later), the first and second rotational position sensors 41 and 43 serve to detect the rotational position of the detecting member 35. To achieve this function, the pair of to-be-detected parts 37 and 39 undergo treatment or processing so that the respective trajectory parts have optical reflectance different from that of a general surface on the detecting member 35. For example, the trajectory parts are cut off or are subjected to coloring (with black, for example) for photoabsorption.

Figure 3:
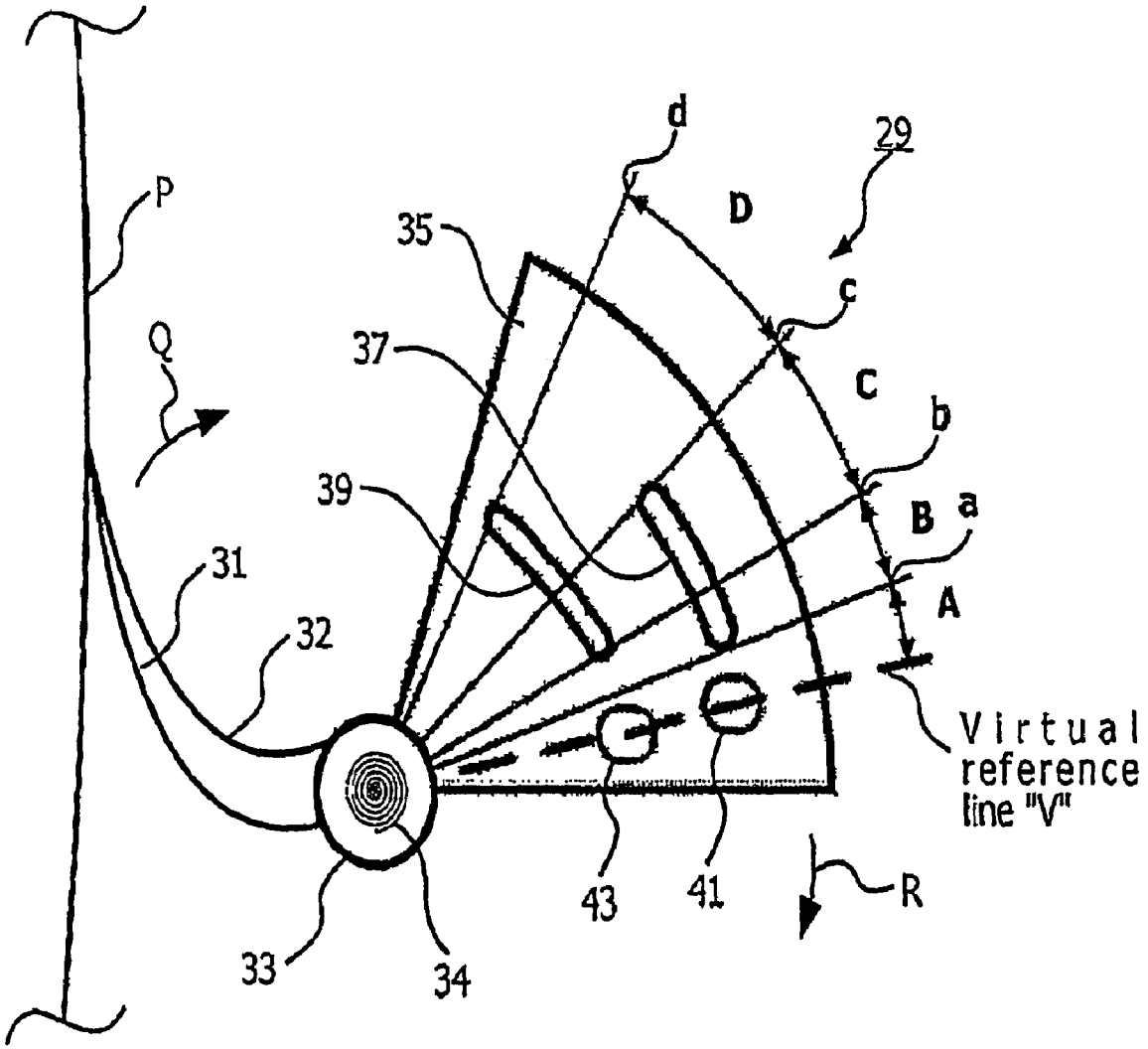
FIG. 3 is an explanatory view for explaining the operation of the loop amount sensor according to the embodiment of the present invention.

A supplementary description of FIG. 3 will be given before giving a description of the operation of the loop amount sensor 29. The thick dotted line of FIG. 3 represents a virtual reference line V. In the positional relationship between the detecting member 35 and the first and second rotational position sensors 41 and 43 shown in FIG. 3, let it be supposed that these are placed in reference positions (rotational angle: 0°) when the loop amount of a sheet material P is zero (0). Additionally, let it be supposed that solid lines a, b, c, and d shown in FIG. 3 are rotated together with the detecting member 35.

In FIG. 3, when the loop amount of a sheet material P passing between the pair of conveyance guide members 25 and 27 increases for the loop amount sensor 29, the sheet material P presses and urges the contact portion 31. As a result, the contact portion 31 changes its position in accordance with the loop amount of the sheet material P, and is rotated on the support shaft 33 in the clockwise direction indicated by an arrow Q. In relation to this, the detecting member 35 is also rotated in the clockwise direction indicated by an arrow R in FIG. 3 together with the contact portion 31 while being supported by the support shaft 33.

At this time, in an area (this area is referred to as "area A") in which the detecting member 35 is rotated and moved (rotational angle: 0° to 7°, loop amount: small) from the reference position to the position where the solid line a and the virtual reference line V coincide with each other, neither the first rotational position sensor 41 nor the second rotational position sensor 43 detects trajectories of the pair of to-be-detected parts 37 and 39, and hence both output signals of the first and second rotational position sensors 41 and 43 are brought into "OFF" (see column A of FIG. 4). Although a description showing a positive logic output signal will be given as follows, the present invention can be applied to a case adopting a negative logic output signal in the same way without being limited to this example.

In an area (this area is referred to as "area B") in which the detecting member 35 is further rotated and moved (rotational angle: 7° to 15°, loop amount: moderately small) from the position where the solid line a and the virtual reference line V coincide with each other to the position where the solid line b and the virtual reference line V coincide with each other, the first rotational position sensor 41 detects the trajectory of the to-be-detected part 37, whereas the second rotational position sensor 43 does not detect the trajectory of the to-be-detected part 39, and hence output signals of the first and second rotational position sensors 41 and 43 are brought into "ON" and "OFF," respectively (see column B of FIG. 4).

In an area (this area is referred to as "area C") in which the detecting member 35 is further rotated and moved (rotational angle: 15° to 30°, loop amount: moderately large) from the position where the solid line b and the virtual reference line V coincide with each other to the position where the solid line c and the virtual reference line V coincide with each other, both the first and second rotational position sensors 41 and 43 detect the trajectories of the pair of to-be-detected parts 37 and 39, respectively, and hence both output signals of the first and second rotational position sensors 41 and 43 are brought into "ON" (see column C of FIG. 4).

In an area (this area is referred to as "area D") in which the detecting member 35 is further rotated and moved (rotational angle: 300 to 500, loop amount: large) from the position where the solid line c and the virtual reference line V coincide with each other to the position where the solid line d and the virtual reference line V coincide with each other, the first rotational position sensor 41 does not detect the trajectory of the to-be-detected part 37, whereas the second rotational position sensor 43 detects the trajectory of the to-be-detected part 39, and hence output signals of the first and second rotational position sensors 41 and 43 are brought into "OFF" and "ON," respectively (see column D of FIG. 4).

Therefore, in the loop amount sensor 29 according to the embodiment of the present invention, the rotational position of the detecting member 35 i.e., the loop amount of a sheet material P can be detected at multiple stages, i.e., at four stages (small, moderately small, moderately large, large) with three thresholds based on output signals of the first and second rotational position sensors 41 and 43 and based on the descriptive contents of the loop amount conversion table shown in FIG. 4.

As described above, in the image forming apparatus according to the embodiment of the present invention, the loop amount sensor 29 detects the rotational position of the detecting member 35, i.e., the loop amount of a sheet material P at multiple stages, i.e., at four stages (small, moderately small, moderately large, large) with three thresholds based on output signals of the first and second rotational position sensors 41 and 43 and based on the descriptive contents of the loop amount conversion table shown in FIG. 4. Consequently, in the drive controller 30, the loop amount of the sheet material P finely detected by the loop amount sensor 29 at the multiple stages is fed back as a controllability driving factor of the transfer roller drive motor (transfer driving portion) 15M and/or the fixing roller drive motor (fixing and driving portion) 21M, and, as a result, the sheet material P can be conveyed while keeping the loop of the sheet material P while passing between the conveyance guide members 25 and 27 at an appropriate amount, and hence a contribution can be made to the formation of an image without transfer deviation or rumples.

The present invention is not limited to the above-mentioned embodiment, and can be properly changed or modified within a range not departing from the spirit of the present invention or the technical idea thereof that can be read from the appended claims or the entire description. Such a modified image forming apparatus is also included in the technical scope of the present invention.

Specifically, although a description has been given of the image forming portion 11 formed to convey a sheet material P upwardly from below in the vertical direction as an embodiment of the present invention, the present invention is not limited to this. The present invention can be applied, without changes, to the image forming portion 11 formed to convey a sheet material P in any direction, such as a horizontal direction or a oblique direction.

Additionally, although a description has been given of the loop amount sensor 29 functioning as a loop amount detecting portion of the present invention that is disposed on the convex side of the loop in a sheet material P passing between the pair of conveyance guide members 25 and 27 as an embodiment of the present invention, the present invention is not limited to this. The loop amount sensor 29 may be disposed on the concave side of the loop in a sheet material P passing between the pair of conveyance guide members 25 and 27.

Additionally, although a description has been given of the detecting member 35 having the pair of to-be-detected parts 37 and 39 that are coaxial with the support shaft 33 at a predetermined distance from the support shaft 33 and that draw continuous trajectories in the circumferential direction as an example of the present invention, the present invention is not limited to this. In the detecting member 35, three or four or more to-be-detected parts that are coaxial with the support shaft 33 and that draw continuous trajectories in the circumferential direction may be disposed at a predetermined distance from the support shaft 33. Thus, this structure makes it possible to finely detect the loop amount of a sheet material P at multiple stages.

Still further, although a description has been given of the electrophotoconductor serving as an image carrier in the embodiment of the present invention, the present invention is not limited to this. A transfer belt may be employed instead of the photoconductor.

Lastly, although a description has been given of, in regard to the loop amount sensor 29 according to the embodiment of the present invention, the loop amount of a sheet material P detected at multiple stages, i.e., at four stages (small, moderately small, moderately large, large) with three thresholds as an embodiment of the present invention, the present invention is not limited to this. As long as the loop amount of a sheet material P can be finely detected at multiple stages, any kind of embodiment is, of course, included within the technical scope of the present invention.

What is claimed is:

1. An image forming apparatus, comprising:

an image carrier for carrying a toner image;

a transferring portion configured to transfer the toner image of the image carrier to a sheet material to obtain a transferred toner image;

a fixing portion configured to fix the transferred toner image on the sheet material;

a fixing and driving portion configured to send the sheet material with the transferred toner image to the fixing portion;

a conveyance guide member configured to guide the sheet material with the transferred toner image to the fixing portion;

a loop amount detecting portion configured to detect, in increments, a loop amount of the sheet material passing by the conveyance guide member; and a drive controller configured to carry out a drive control of the fixing and driving portion based on a detection result of the loop amount detecting portion, the loop amount detecting portion comprising a contact portion configured to contact the sheet material passing by the conveyance guide member such that said contact portion changes position in accordance with the loop amount of the sheet material, a support shaft configured to support the contact portion for rotation about an axis of the support shaft, an urging member configured to urge the contact portion toward a back side of the sheet material, a detecting member configured to rotate with a change of position of the contact portion, said detecting member being supported by the support shaft for rotation about the axis of the support shaft and being configured so that said detecting member rotates in response to a change in a loop amount of the sheet material, and a rotational position sensor configured to detect a rotational position of the detecting member, the detecting member having a to-be-detected part that is configured to rotate about the axis of the support shaft, and the rotational position sensor is disposed in a position corresponding to a trajectory of the to-be-detected part so as to detect a rotational position of the detecting member by detecting the presence or absence of the to-be-detected part in a portion of the trajectory of the to-be-detected part, the detecting member including at least one additional to-be-detected part that is configured to rotate about the axis of the support shaft, each to-be-detected part is formed at a predetermined distance from the support shaft, has a predetermined width and a predetermined length, and is on a different angular phase from others of said to-be detected parts relative to the axis of the support shaft;

at least one additional rotational position sensor and said rotational position sensor are respectively disposed in positions corresponding to respective trajectories of to-be-detected parts, and the image forming apparatus is configured to detect the rotational position of the detecting member by detecting the presence or absence of the to-be-detected parts in respective portions of the trajectories of said to-be-detected parts.

2. The image forming apparatus of claim 1, wherein the contact portion is bent at an intermediate part of the contact portion so that a tip end of the contact portion forms an acute angle with a direction of movement of the sheet material.

3. The image forming apparatus of claim 1, wherein the rotational position sensor comprises a photointerrupter.

4. The image forming apparatus of claim 1, wherein the loop amount detecting portion is disposed approximately at a midpoint of a sheet material conveying path leading from the transferring portion to the fixing portion.

5. The image forming apparatus of claim 1, wherein the loop amount detecting portion is disposed at a convex side of a loop formed by the sheet material passing by the conveyance guide member.

* * * * *